US006225990B1

(12) United States Patent
Aoki et al.

(10) Patent No.: US 6,225,990 B1
(45) Date of Patent: May 1, 2001

(54) METHOD OF DRIVING DISPLAY APPARATUS, DISPLAY APPARATUS, AND ELECTRONIC APPARATUS USING THE SAME

(75) Inventors: Toru Aoki; Nobuyuki Shimotome, both of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/952,949

(22) PCT Filed: Mar. 26, 1997

(86) PCT No.: PCT/JP97/01034

§ 371 Date: Nov. 25, 1997

§ 102(e) Date: Nov. 25, 1997

(87) PCT Pub. No.: WO97/37338

PCT Pub. Date: Oct. 9, 1997

(30) Foreign Application Priority Data

Mar. 29, 1996 (JP) ..... 8-077870

(51) Int. Cl.[7] ..... G09G 5/00

(52) U.S. Cl. ..... 345/204; 345/132; 345/103; 348/458

(58) Field of Search ..... 345/87, 103, 132, 345/204, 38, 104, 55, 90, 112; 348/206, 458, 550

(56) References Cited

U.S. PATENT DOCUMENTS 5,473,382 * 12/1995 Nohmi et al. ..... 348/448
5,488,389 * 1/1996 Nakanishi et al. ..... 345/131
5,675,354 * 10/1997 Katakura et al. ..... 345/97
5,754,160 * 5/1998 Shimizu et al. ..... 345/103
5,838,381 * 11/1998 Kasahara et al. ..... 345/458

FOREIGN PATENT DOCUMENTS 5-167957 7/1993 (JP) .
5-303362 11/1993 (JP) .

* cited by examiner

*Primary Examiner*—Vijay Shankar
*Assistant Examiner*—Mansour M. Said
(74) *Attorney, Agent, or Firm*—Oliff & Berridge, PLC

(57) ABSTRACT

A display apparatus has a plurality of display scanning lines and supplies image signals for a number of image scanning lines less than the number of the plurality of display scanning lines to display elements controlled by the plurality of display scanning lines. The apparatus includes: storage member for storing image signals corresponding to a number of image scanning lines less than the number of the plurality of display scanning lines at least by an amount corresponding to one image scanning line; control member for reading image signals for one image scanning line stored in the storage member N times (an integer of 1 or more); and driving member for supplying image signals read N times by the control member to display elements controlled by N display scanning lines. By changing the number N of times in which the image signals are read from the storage member within one vertical scanning period, the image is displayed on the entire display apparatus at each vertical scanning period even when the number of image scanning lines within one vertical scanning period is less than the number of display scanning lines of the display apparatus.

17 Claims, 10 Drawing Sheets

METHOD OF DRIVING DISPLAY APPARATUS, DISPLAY APPARATUS, AND ELECTRONIC APPARATUS USING THE SAME

DESCRIPTION

1. Field of the Invention

The present invention relates to a method of driving a display apparatus which has a plurality of scanning lines and which supplies image signals for a number of scanning lines smaller than the foregoing number of scanning lines to display elements. Further, the present invention relates to a display apparatus using the driving method.

Furthermore, the present invention relates to an electronic apparatus using the display apparatus.

2. Background Technology

In an image display apparatus for displaying image signals of the NTSC system, hitherto, image signals are standardized in such a way that 525 scanning lines form one screen. Therefore, as a display apparatus for displaying these image signals, a display apparatus is used having the above-described 525 scanning lines in the vertical direction of the screen.

Meanwhile, in recent years, in response to increased needs of the user, display apparatuses having 525 or more scanning lines have been developed one after another. However, for image signals of an interlace (interlaced scanning) system in the NTSC system, the image signals of one frame are formed by the interlaced scanning of the image signals of a first field and the image signals of a second field, and the number of effective scanning lines of the image signals of one field is as small as approximately 220. Therefore, the number of scanning lines of the image signals of one field is smaller than the number of scanning lines (525 or more) of the display apparatus. Hence, there are drawbacks in that the image signals cannot be supplied periodically to the whole of the scanning lines, i.e., all of the pixels.

If the image signals are supplied to only the number of scanning lines corresponding to the image signals among the whole of the scanning lines of an image display apparatus, an image is displayed only on a part of the screen. Therefore, even though the display apparatus has a number of pixels (a number of scanning lines) for high resolution, they all cannot be utilized.

Further, in an image display apparatus such as a liquid-crystal device, when image signals such that one field is formed of 220 scanning lines are interlace-scanned and supplied, the cycle of supply of the image signals to each pixel becomes a one-frame cycle, causing flicker to occur.

The present invention has been achieved in view of such circumstances. It is an object of the present invention to provide a display apparatus capable of periodically supplying image signals to the pixels of the entire screen even when the number of scanning lines of the screen is greater than the number of scanning lines of the image signals.

SUMMARY OF THE INVENTION

In a first aspect, there is provided a method of driving a display apparatus in accordance with the present invention which has a plurality of scanning lines and which supplies image signals for a number of scanning lines smaller than the number of the plurality of scanning lines to display elements controlled by the plurality of scanning lines, wherein the image signals of each scanning line are supplied to display elements controlled by N (N is an integer) scanning lines of the display apparatus, respectively, and within one vertical scanning period, the number N of scanning lines corresponding to the display elements to which the same image signals are supplied is changed according to the sequence number of the scanning lines of the image signals.

Further, in a second aspect of the present invention, there is provided a method of driving a display apparatus which has a plurality of scanning lines and which supplies image signals for a number of scanning lines smaller than the number of the plurality of scanning lines to display elements controlled by the plurality of scanning lines, the method comprising the steps of:

storing the image signals of each scanning line in storage means;

reading the same image signals for one scanning line stored in the storage means N times (N is an integer) within one horizontal scanning period;

supplying the same image signals read N times to display elements controlled by N scanning lines of the display apparatus; and changing the number N of times of reading within one vertical scanning period.

Further, in a third aspect of the present invention, there is provided a display apparatus which has a plurality of scanning lines and which supplies image signals for a number of scanning lines smaller than the number of the plurality of scanning lines to display elements controlled by the plurality of scanning lines, the display apparatus comprising:

storage means for storing image signals corresponding to a number of scanning lines smaller than the number of the plurality of scanning lines at least by an amount corresponding to one scanning line;

control means for reading image signals for one scanning line stored in the storage means N times (N is an integer); and driving means for supplying the same image signals read by the control means N times to display elements controlled by N scanning lines, wherein the number N of times in which the image signals are read from the storage means is changed within one vertical scanning period.

Further, there are two types of numbers N of scanning lines corresponding to display elements to which the same image signals are supplied within one vertical scanning period, and the two types are switched according to the sequence number of the scanning lines of the image signals read from the storage means.

As a result of the above, even if the number of scanning lines of the image signals within one vertical scanning period (one field or one frame) is smaller than the number of all the scanning lines of a liquid-crystal panel, it is possible to select all of the scanning lines. Therefore, it is possible to perform a display fully utilizing the functions of the high-resolution display apparatus. Further, since, by changing N, the image signals for the effective scanning lines of the image signals to be displayed are displayed using all of the scanning lines on a display apparatus, there is no need to thin out the scanning lines of the image signals, and it is possible to perform a reproduction display utilizing the original image information to its fullest extent. Further, if N is of two values and it can be switched in accordance with a predetermined rule, the circuitry of the control means becomes easy.

Further, if expressed by general equations, the values of N become the values N1, N2, . . . Ni (i is an integer of 2 or more) which satisfy all the following equations (1), (2) and (3), $$L=M1+M2+\ldots+Mi \quad (1)$$

$$Hm=N1\times M1+N2\times M2+\ldots+Ni\times Mi \quad (2)$$

$$L<Hm \quad (3)$$

L: the number of effective scanning lines of the image signals within one vertical scanning period Hm: the number of effective scanning lines of the display apparatus Ni: the number of scanning lines of the display apparatus, selected to supply the same image signals for one scanning line to the display elements Mi: the number of scanning lines of the image signals within one vertical scanning period, which the same image signals for said scanning line are generated Ni times.

Further, to be specific, in order to cause a SVGA display apparatus to perform a display, L is set to 220, Hm is set to 600, N1 is set to 3, N2 is set to 2, M1 is set to 160, and M2 is set to 60.

Further, a method of varying the number N of scanning lines corresponding to the display elements to which the same image signals are supplied within one vertical scanning period is changed at each vertical scanning period.

To be more specific, there are two types of numbers N of scanning lines corresponding to the display elements to which the same image signals are supplied within one vertical scanning period, these two types are selected according to the sequence number of the scanning lines of the image signals, and this selection method is further switched at each vertical scanning period.

As a result of the above, a part of the whole of an image in one screen becomes an image which is always extended in a horizontal stripe shape, and an image close to the original image cannot be reproduced. However, in the present invention, by changing the selection method at each vertical scanning period, in an image display which has passed through a plurality of vertical scanning periods, the positions at which the same image signals are displayed are scattered and made uniform over the entire screen, causing the resolution to increase. In particular, in a moving-image display, since the contours of the original image are obscure and there is movement, such a display is suitable for the adoption of the method of the present invention, and a high-quality image display can be achieved. Further, by making N to be two types of values, the construction of a control circuit for switching two types can be simplified.

Further, it is possible to realize the display apparatus by using liquid crystals for the display elements.

In addition, the use of this display apparatus as an image display apparatus in an electronic apparatus makes it possible to realize an electronic apparatus having a high-resolution display apparatus.

DETAILED DESCRIPTION OF THE PREFERRED EMBODIMENTS

An embodiment of the present invention will be described below with reference to the accompanying drawings.

An image display apparatus according to an embodiment which will be described below displays, as an example, image signals of the NTSC system on a SVGA (Super Video Graphic Array) liquid-crystal panel (horizontal 800 dots× vertical 600 dots).

Figure 1A:
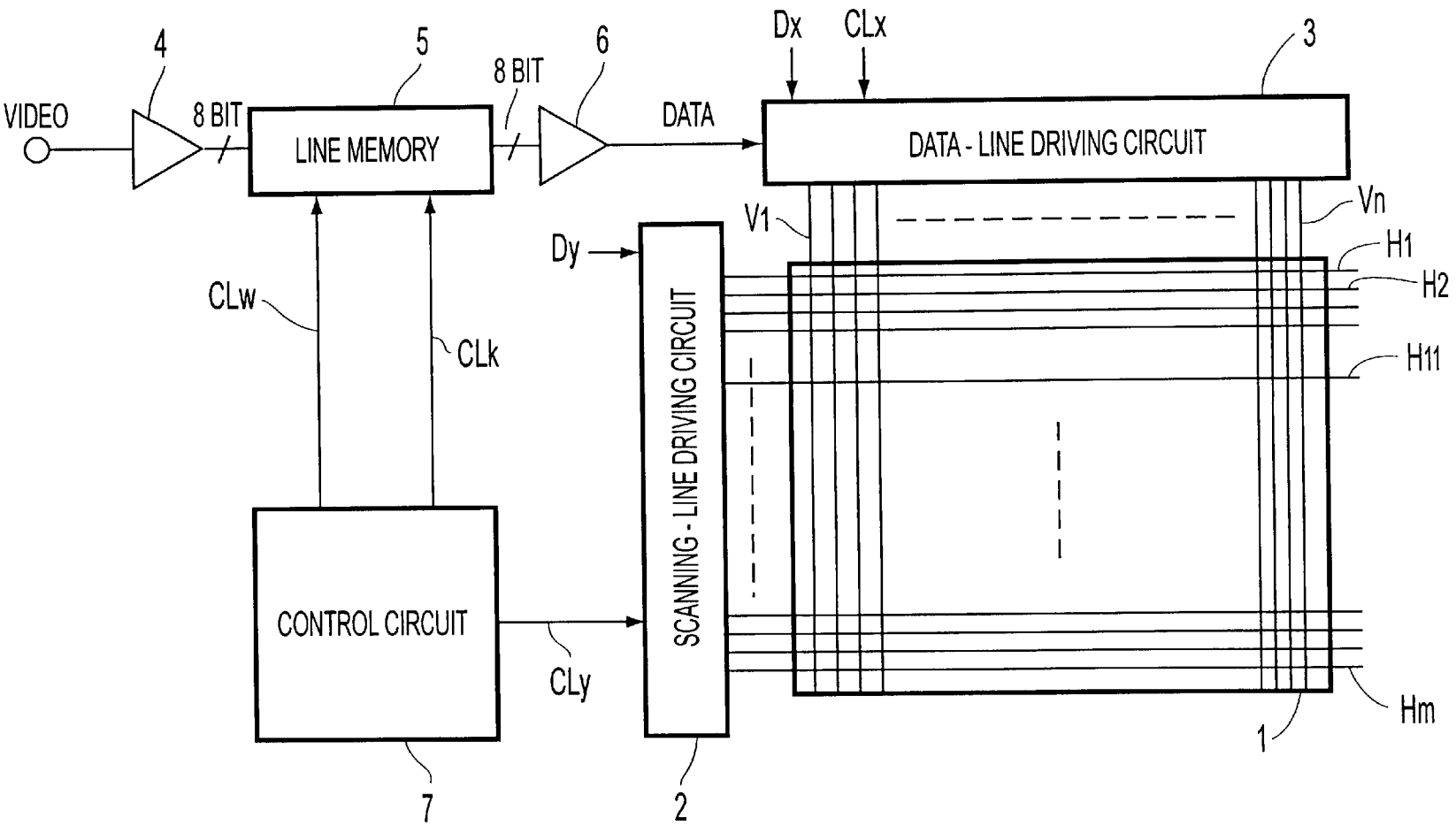
FIGS. 1(*a*) and 1(*b*) show the construction of a display apparatus according to an embodiment of the present invention.
Figure 1B:
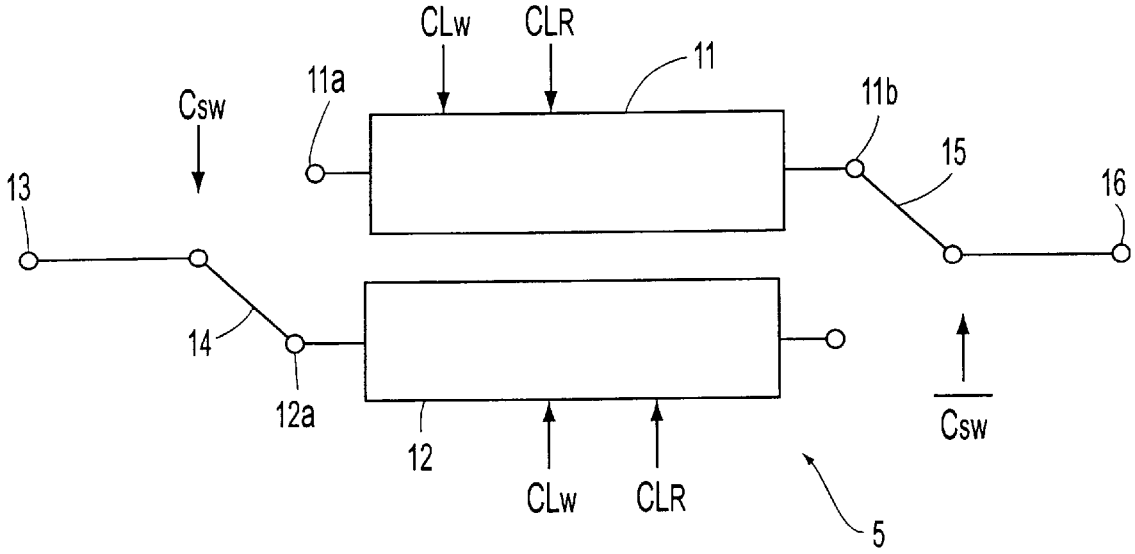
Figure 2:
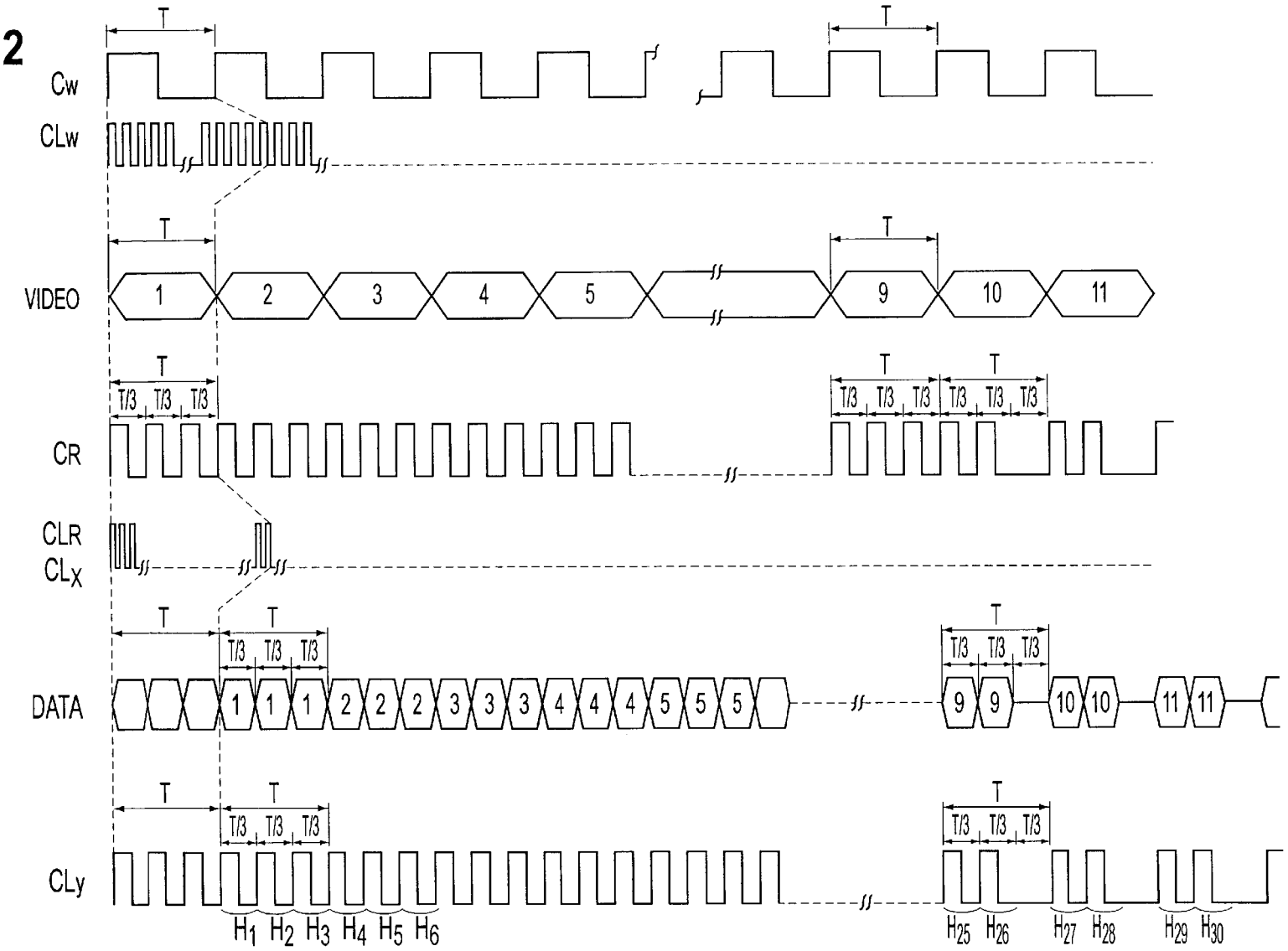
FIG. 2 is a waveform chart illustrating each signal waveform for supplying image signals in a first field (odd-number field) to the display apparatus.
Figure 3:
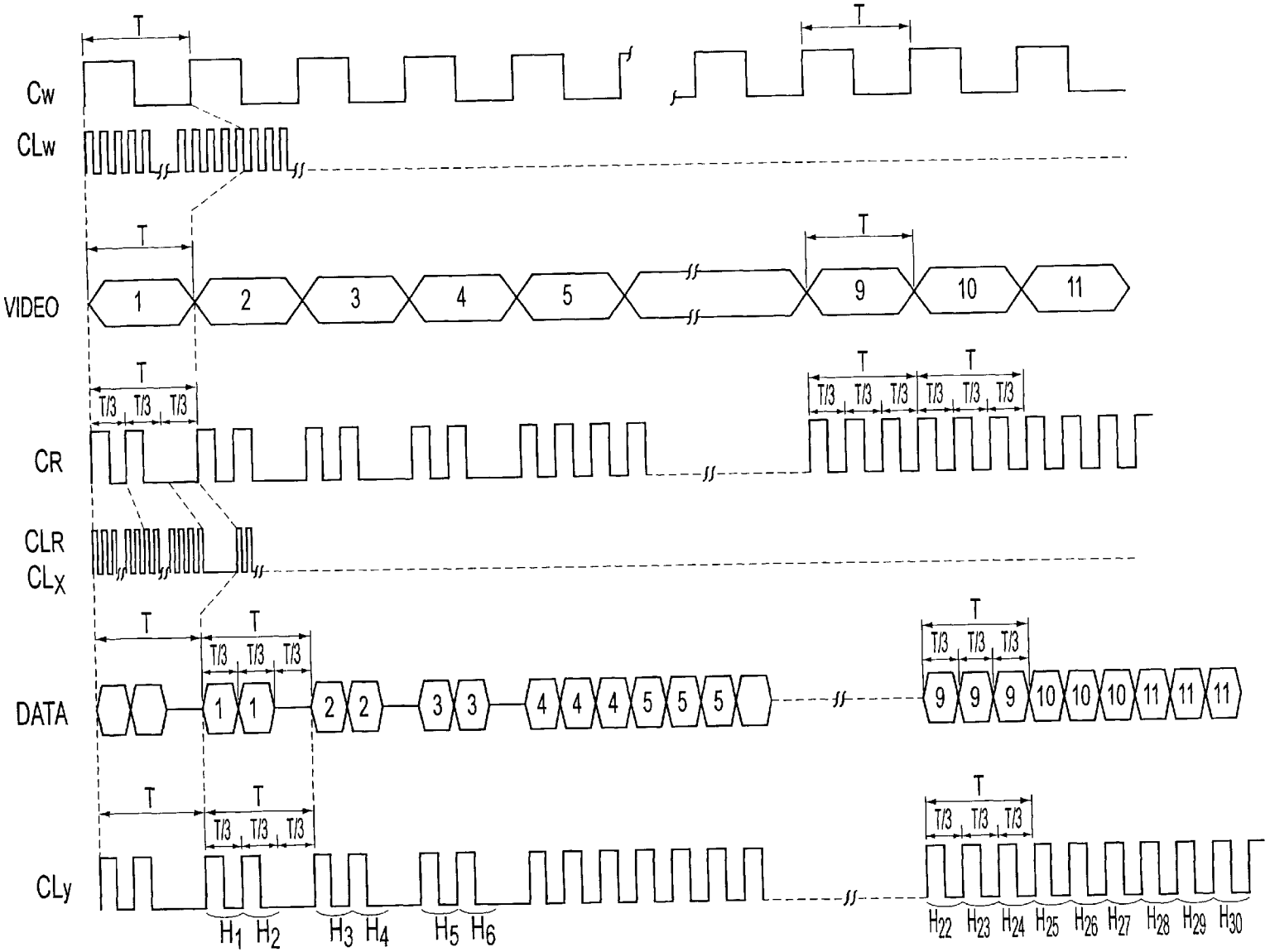
FIG. 3 is a waveform chart illustrating each signal waveform for supplying image signals in a second field (even-number field) to the display apparatus.

FIGS. 1A and 1B is a block diagram illustrating the construction of a display apparatus according to the embodiment of the present invention. FIGS. 2 and 3 are timing charts illustrating the operation in the display apparatus in FIG. 1. FIG. 2 shows the driving operation for displaying image signals in a first field (odd-number field) of the interlace system in the NTSC system, whereas FIG. 3 shows a driving operation in a second field (even-number field).

(Description of FIGS. 1A and 1B)

In FIG. 1(*a*), reference numeral 1 denotes an active-matrix-type liquid-crystal apparatus. As is well known, in a liquid-crystal apparatus, a liquid-crystal layer is sandwiched between a pair of substrates, and the orientation direction of the liquid-crystal molecules is changed by a voltage applied between a pair of electrodes by which the liquid-crystal layer is sandwiched. When the liquid crystal is of a twisted-nematic type, a pair of polarizing plates are disposed outside the pair of substrates, and light transmittance is controlled on the basis of the relationship between the polarization axis of the pair of polarization plates and the orientation direction of the liquid-crystal molecules, thereby making a display (also called modulation).

On the inner surface of the substrate of the liquid-crystal panel 1, scanning lines H1 to Hm (m=600) are arranged in the horizontal direction (in the transverse direction in the figure) at predetermined intervals along the vertical direction (along the longitudinal direction in the figure). That is, this liquid-crystal panel 1 is made to have 600 effective scanning lines in the vertical direction. Also, on the inner surface of the substrate of the liquid-crystal panel 1, data lines V1 to Vn (n=800) are arranged in the vertical direction (in the longitudinal direction in the figure) at predetermined intervals along the horizontal direction (along the transverse direction in the figure). That is, in the liquid-crystal panel 1, scanning lines and data lines are arranged in a matrix form, with pixels being arranged in correspondence with the intersection points thereof, and the liquid-crystal panel 1 is formed of horizontal 800×vertical 600=480,000 pixels. Each pixel contains a liquid crystal, pixels are selected in row units in accordance with signals of the scanning lines, and image signals are supplied from data lines to the liquid crystals of the selected pixels.

Reference numeral 2 denotes a scanning-line driving circuit, which is formed of shift registers of m (=600) bits provided in correspondence with each of the above-described scanning lines H1 to Hm, and the like. In the shift registers of the scanning-line driving circuit 2, shift data Dy input at each vertical scanning period (one field) is shifted in sequence in accordance with a shift clock CLy for driving the scanning lines, and an output is made in sequence from each bit of the shift register. Based on the output, the scanning lines of the scanning lines H1 to Hm are selected in sequence, and scanning signals (selection signals) are supplied to the selected scanning lines. FIGS. 2 and 3 show the shift clock CLy input to the shift register of the scanning-line driving circuit in each field.

Reference numeral 3 denotes a data-line driving circuit, which is formed of shift registers for sequentially shifting shift data Dx input at each predetermined period shorter than one horizontal scanning period of the image signals of the NTSC system in accordance with a shift clock CLx for driving data lines, n switching elements, provided in correspondence with data lines V1 to Vn respectively, for sequentially supplying image signals to each of the data lines V1 to Vn as a result of being switched in accordance with each output of the shift registers, and the like. This data-line driving circuit 3 supplies the image signals Data for one scanning line to the selected pixels for one row controlled by the scanning line selected by the above-described scanning-line driving circuit 2, via the data lines V1 to Vn.

FIGS. 2 and 3 show the shift clock CLx input to the shift register of the data-line driving circuit in each field.

Reference numeral 4 denotes an A/D (analog/digital) conversion circuit, which converts input image signals Video of the NTSC system into a digital amount (e.g., 8 bits). These image signals Video are image signals of an interlace (interlaced scanning) system in the NTSC system. That is, the above-described image signals Video are formed of the signals of a first field (also called an odd-number field, for example, the number of effective scanning lines is 220), and the signals of a second field (also called an even-number field, for example, the number of effective scanning lines is 220). That is, the image signals Video of the first field and the image signals Video of the second field are alternately input in a time-sequence manner to the A/D conversion circuit 4. The image signals of each scanning line, as shown in FIGS. 2 and 3, are input at each horizontal scanning period T of the NTSC system.

Next, reference numeral 5 of FIG. 1(*a*) denotes a line memory for storing digitized image signals Video in units of scanning lines. The details of this line memory 5 will be described later with reference to FIG. 1(*b*).

The image signals Video in units of scanning lines, stored in the line memory 5, are read in units of scanning lines from the memory, and reproduced into analog signals Data in a D/A (digital/analog) conversion circuit 6. The analog image signals Data are input to the data-line driving circuit 3 described above, are sampled in sequence by n switching elements which operate in accordance with the shift operation of the shift register and supplied to each of the data lines V1 to Vn.

Reference numeral 7 denotes a control circuit for generating timing signals for each circuit. The control circuit 7 also generates various timing signals (not shown).

(Method of Driving a Liquid-Crystal Panel based on the Construction in FIG. 1)

In the construction of such a display apparatus, in the present invention, within one vertical scanning period in which image signals are supplied to the pixels of all the scanning lines of the liquid-crystal panel 1, the image signals for one scanning line read from the line memory 5 are read at a speed higher than the frequency of writing into the memory and are repeatedly read in succession, so that the same image signals for one scanning line are supplied to the pixels which are respectively selected by a plurality of scanning lines of the liquid-crystal panel 1 within one horizontal scanning period T. Further, the number N of times in which the image signals for the same scanning line are read from the line memory 5 is changed every predetermined lines within one vertical scanning period. Further, in the present invention, the sequence of the above-described number N of times of successive reading is also changed between the first field and the second field.

For example, in the embodiment, the image signals for eight scanning lines are each read in succession three times. The same image signals for one scanning line are read three times, and the image signals are displayed on three display lines ("display line" refers to a pixel row selected by one scanning line) of the liquid-crystal panel 1. Further, the image signals for the next three scanning lines are each repeatedly read two times. The same image signals for one scanning line are read two times, and the image signals are displayed on two display lines. This is alternately switched with eight scanning lines being one unit and three scanning lines being one unit.

As a result of the above, when each image signal for eight scanning lines is supplied respectively to three display lines of the liquid-crystal panel, and each image signal for three scanning lines is supplied to the two display lines of the liquid-crystal panel, and these are repeated alternately and each for 20 number of times, $$3\times(8\times20)+2\times(3\times20)=600 \quad \text{(A)}$$

As in equation (A), all of the effective scanning lines (600) of the liquid-crystal panel 1 are selected within one vertical scanning period, and the image signals can be supplied to all of the pixels.

Further, in the first field, the number N of times of reading is set as 3→2→3→2→3 . . . , and in the second field, the number N of times is reversed as 2→3→2→3→2 . . . . For this reason, in the liquid-crystal panel 1, the number of display lines to which the same image signals are supplied within one vertical scanning period changes as 3→2→3→2→3 . . . in the first field, and in the second field, the number of display lines changes as 2→3→2→3→2 . . . Therefore, since the display lines on the screen on which the same image signals are displayed shift at each field (one vertical scanning period), the resolution is improved. That is, since the image signals in different fields are image signals at different positions within the screen, if these image signals are displayed at the same position of the liquid-crystal panel in each field, the resolution deteriorates. However, in the present invention, since this position is shifted, it is possible to make a display without deteriorating much of the resolution of the original image signals.

Figure 6A:
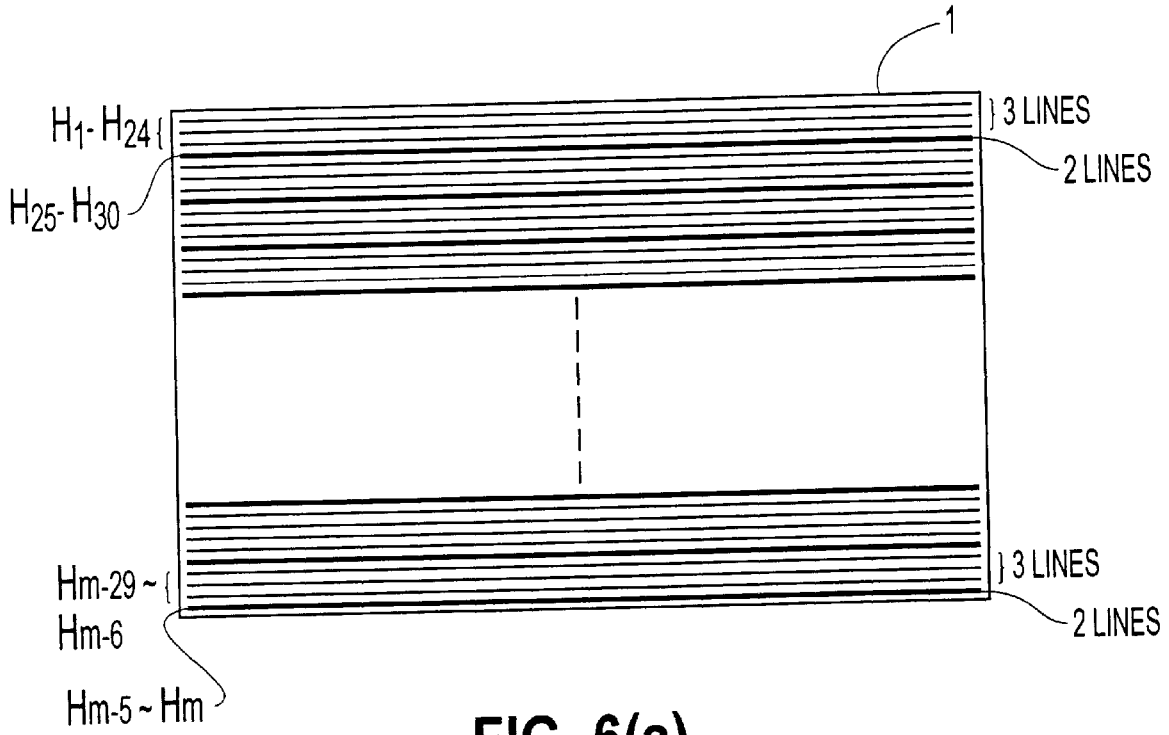
FIGS. 6(*a*) and 6(*b*) show a method of selecting scanning lines of the display apparatus in the first and second fields.
Figure 6B:
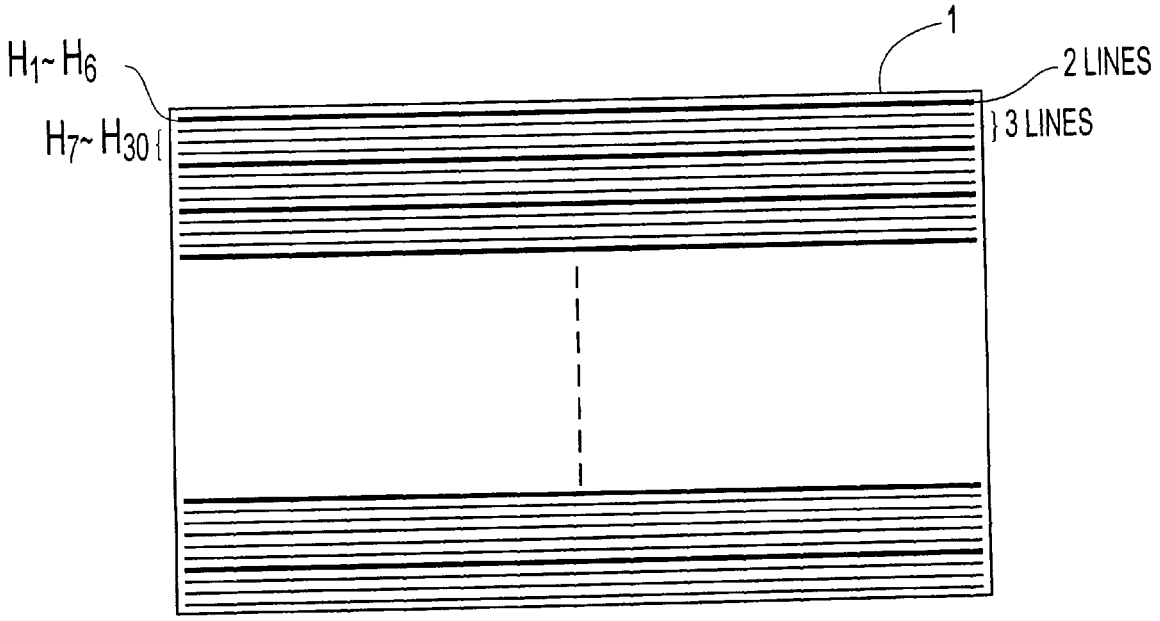

FIGS. 6(*a*) and 6(*b*) schematically show the above-described driving method. Shown in FIGS. 6(*a*) and 6(*b*) is a method of selecting all of the scanning lines of the liquid-crystal panel 1. FIG. 6(*a*) shows a method of selecting the first field, and FIG. 6(*b*) shows a method of selecting a second field.

As shown in FIG. 6(*a*), in the first field, initially, the same image signals for one scanning line read from the line memory 5 are supplied to the pixels selected by the scanning lines H1 to H3 of the liquid-crystal panel 1. Since this is repeated for the eight scanning lines of the image signals as described earlier, the scanning lines are selected in units of three scanning lines from scanning line H1 to scanning line H24, and the image signals of the same scanning line are supplied in each unit to the pixels selected in units of these scanning lines. Next, the same image signals for one scanning line read from the line memory 5 are supplied to the pixels selected by the scanning lines H25 and H26. Since this is repeated for three scanning lines of the image signals as described earlier, the scanning lines are selected in units of two scanning lines from scanning line H25 to scanning line H30, and the image signals of the same scanning line are supplied in each unit to the pixels selected in units of these scanning lines. By repeating these selection methods alternately, selection up to scanning line Hm becomes possible.

On the other hand, in the second field shown in FIG. 6(*b*), contrary to the case of the first field, selection in units of two scanning lines of the liquid-crystal panel 1 is started first. Next, selection in units of three scanning lines of the liquid-crystal panel 1 is continued. That is, from scanning line H1 to scanning line H6, selection in units of two scanning lines is made, and the image signals of the same scanning lines are supplied to the pixels selected by two scanning lines which serve as units. Next, from scanning line H7 to scanning line H30, selection in units of the three scanning lines is made and the image signals of the same scanning line are supplied to the pixels selected by three scanning lines which serve as units. By repeating these selection methods alternately, selection up to scanning line Hm becomes possible.

As described above, even if the number of scanning lines of the image signals for one vertical scanning period (one field or one frame) is smaller than the total number of scanning lines of the liquid-crystal panel, it is possible to select all of the scanning lines. Further, unless the selection method is changed, a part of an image in one screen becomes an image which is always extended in a stripe shape, and an image close to the original image cannot be reproduced. However, in the present invention, by changing the selection method at each vertical scanning period, the positions at which the same image signals are displayed are scattered in one frame period and made uniform over the entire screen, causing the resolution to increase.

(Description of the Operation in FIG. 1)

The driving method based on the above construction of FIG. 1(*a*) will be described with reference to FIGS. 1(*b*), 2 and 3.

The details of the line memory 5 in FIG. 1(*a*) are shown in FIG. 1(*b*). Reference numerals 11 and 12 each denote a line memory capable of storing digital image signals for one scanning line. Reference numeral 13 denotes a terminal to which image signals (one dot comprises 8 bits) in units of one scanning line digitized by the A/D conversion circuit 4 are supplied in a time-sequence manner. The image signals from the terminal 13 are supplied to either input terminal 11*a* or 12*a* of the line memory by a switch 14 alternately at each horizontal scanning period T. Upon receiving a control signal Csw, the switch 14 performs switching at each horizontal scanning period T. The image signals for one scanning line supplied to the input terminal are written in sequence into the line memory (11 or 12) in synchronization with a writing clock CLw shown in each of FIGS. 2 and 3. For example, in FIG. 2, image signals Video1 for the first scanning line are input in sequence in synchronization with a reference clock Cw for one horizontal scanning cycle and stored in sequence in the line memory 11 in accordance with the writing clock CLw. In the next horizontal scanning period, the switch 14 is switched in accordance with Csw, and image signals Video2 for the second scanning line are stored in sequence in the memory 12 in accordance with the clock CLw. In this way, the image signals for one scanning line are alternately stored in the line memories 11 and 12 at each horizontal scanning period T.

Here, the above-mentioned image signals for one scanning line refer to the image signals Video in one horizontal scanning period T shown in FIG. 2, and refer to signals corresponding to the number (=800) of dots in the horizontal direction of the liquid-crystal panel 1 shown in FIG. 1(*a*). That is, the above-mentioned amount of 800 dots in the horizontal direction, in other words, the image signals Video for one scanning line, are stored in sequence in dot units in the line memories 11 and 12. Therefore, there are 800 pulses of the writing clock CLw within the horizontal scanning period T.

More specifically, the image signals Video of each field are image signals for 220 scanning lines (one scanning line=800 dots), and the total period of that one field is set to 200T. The reference numerals shown in FIGS. 2 and 3 denote the scanning-line sequence numbers of the image signals Video, for example, "1" indicates the first scanning line of the image signals Video.

The operation of writing image signals into the memories 11 and 12 is the same manner in each field in FIGS. 2 and 3.

On the other hand, the operation of reading from the line memories 11 and 12 is performed at a speed higher than that of the writing operation. Further, the reading operation changes cyclically within one field period and changes at each field.

In FIG. 1(*b*), reference numeral 16 denotes an output terminal which outputs digital image signals (1 dot comprises 8 bits) to a D/A conversion circuit 6 in a time-sequence manner. Image signals read from the line memories 11 and 12 are supplied to this output terminal 16 via a switch 15. Reference numerals 11*b* and 12*b* each denote an output terminal from each memory. The switch 15 is controlled in accordance with a control signal/Csw in a phase opposite to that of the switch 14. Therefore, when the switch 14 supplies image signals to the memory 12 and the memory 12 is in a writing period, the switch 15 selects the memory 11 and the memory 11 is in a reading period. The image signals read from the memory 11 are output to the terminal 16. These switches 14 and 15 are complementary switches. In the next horizontal scanning period, the switch 14 selects the memory 11, and the switch 15 selects the memory 12. That is, the switching between the switches 14 and 15 is alternately reversed at each horizontal scanning period.

Next, the following is a method of reading from the line memories 11 and 12.

In the first field shown in FIG. 2, in a second horizontal scanning period T2 in which the image signals Video2 for the second scanning line are stored in sequence in the memory 12, the image signals Video1 for the first scanning line, which have already been written in the previous horizontal scanning period T1, has been stored in the memory 11. Therefore, in the horizontal scanning period T2, the memory 12 is placed in a writing period, and the memory 11 is placed in a reading period. Reference letter CR in FIG. 2 denotes a reading timing clock; there are three pulses in one horizontal scanning period T2. Therefore, the memory 11 is read three times at a speed three times faster than that during writing in synchronization with the clock CR within one horizontal scanning period. Each reading period becomes T/3. Reference letter CLR denotes a reading clock. There are 800 pulses of this clock CLR within the T/3 period, and within the T/3 period, the image signals for one scanning line stored in the memory 11, corresponding to 800 dots, are read in sequence in dot units. This is repeated three times within one horizontal scanning period. Reference letter "Data" in FIG. 2 denotes read image signals; Data1 each denotes image signals for one scanning line. The image signals which are repeatedly read three times are converted from digital to analog form, supplied to the data-line driving circuit 3, and supplied to the data lines V1 to Vn. The scanning-line driving circuit 2 sequentially selects the scanning lines in synchronization with the shift clock CLy. Therefore, Data1 which is supplied to the data-line driving circuit 3 three times in succession are sequentially supplied to the pixels selected by the three scanning lines of scanning lines H1, H2 and H3 of the liquid-crystal panel 1. The shift clock CLx supplied to the shift register of the data-line driving circuit is shown as a clock having the same cycle in order to sample the image signals in dot units read in accordance with the reading clock CLR.

In the next horizontal scanning period T3, the switch 14 is connected to the memory 12, causing the image signals for the third scanning line to be written into the memory 12. On the other hand, since the switch 15 is connected to the memory 11, the memory 11 is placed in a reading period, and the memory 12 is placed in a writing period. Similar to the case of the horizontal scanning period T2, within one horizontal scanning period T3, the image signals are read from the memory 11 three times in succession in accordance with the reading clock CLR in each T/3 period determined by the timing clock CR. Further, the image signals Video2 for one scanning line read three times in succession are supplied to the pixels selected by the scanning lines H4, H5 and H6 of the liquid-crystal panel 1.

In the above-described way, for the image signals for the first to eighth scanning lines, the same image signals for one scanning line are each read three times from the memory and supplied to the pixels of the scanning lines H1 to H24 of the liquid-crystal panel 1.

Further, starting from the image signals of the ninth scanning line, a reading method changes. In a tenth horizontal scanning period T10, the image signals for one scanning line stored in the memory 11 in the previous period T9 are read two times in succession in accordance with the reading clock CLR in synchronization with the timing clock CR. The image signals for one scanning line are read in the T/3 period. The same image signals for one scanning line read two times in succession are supplied to the scanning lines H25 and H26 of the liquid-crystal panel 1. Since CLy indicates the timing at which scanning lines of the liquid-crystal panel are selected, the number of times of reading from the memory becomes equal to the number of selections of the scanning lines (i.e., the number of display lines). This reading method is performed for the image signals of the ninth to eleventh scanning lines, and the image signals are supplied to the pixels of the scanning lines H25 to H30 of the liquid-crystal panel 1.

As described above, since reading of image signals and supply of them to pixels are performed in units of 8 scanning lines and in units of 3 scanning lines of the image signals, and these are repeated alternately, the image signals are supplied to the pixels of all of the scanning lines H1 to Hm (m=600 in the embodiment) of the liquid-crystal panel within one vertical scanning period (one field).

Meanwhile, the reading operation in the second field is as described below.

As shown in FIG. 3, in the second field, initially, similar to the case of the ninth scanning line of the first field, the image signals for one scanning line are read two times in succession from the memory and supplied respectively to the pixels of two scanning lines of the liquid-crystal panel. By performing this for three scanning lines of the image signals, the image signals are supplied to the pixels of the scanning lines H1 to H6 of the liquid-crystal panel. For example, since the image signals Video1 for the first scanning line are stored in the memory 11 in the first horizontal scanning period T1, the signals are read two times in succession from the memory 11 in accordance with the reading clock CLR in the second horizontal scanning period T2. These image signals Video1 are supplied to the pixels of the scanning lines H1 and H2 selected in accordance with the timing of CLy.

Next, starting from the image signals of the fourth scanning line, the signals are read three times in succession from the memory. Therefore, in a fifth horizontal scanning period T5, the number of pulses of the reading timing clock CR becomes three in the period T, and the image signals Video4 of the fourth scanning line stored in the memory 12 in the immediately previous horizontal scanning period T4 are read three times in succession in accordance with the reading clock CLR. Then, the image signals are supplied to the pixels of the scanning lines H7 to H9 of the liquid-crystal panel. Since this is performed for eight scanning lines of the image signals, the image signals are supplied to the scanning lines H7 to H30 of the liquid-crystal panel by a similar method.

As described above, since reading of image signals and supply of them to pixels are performed in units of 8 scanning lines and in units of 3 scanning lines of the image signals, and these are repeated alternately, the image signals are supplied to the pixels of all of the scanning lines H1 to Hm (m=600 in the embodiment) of the liquid-crystal panel within one vertical scanning period (one field).

Figure 4:
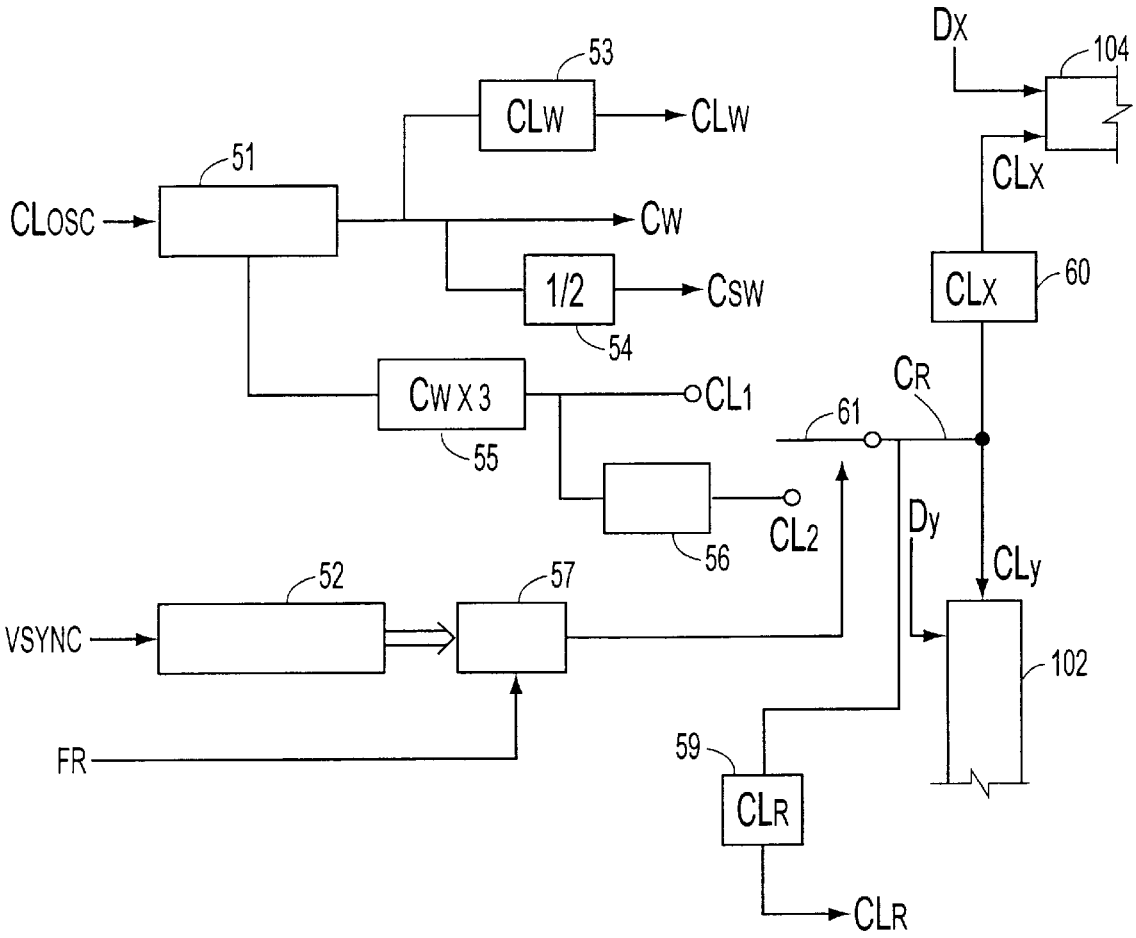
FIG. 4 is a circuit diagram for generating signal waveforms in FIGS. 2 and 3.

(Description of FIG. 4)

FIG. 4 shows an example of the control circuit 7 for generating various timing signals in FIGS. 1, 2 and 3.

A horizontal counter 51 counts a dot clock CLOSC and generates a horizontal scanning clock Cw. The Cw has a cycle of one horizontal scanning period T. Further, a CLw generation circuit 53 generates a writing clock CLw for writing into a line memory, which is synchronized with the clock Cw and has a frequency higher than that of the writing clock CLw. Further, a ½ frequency-dividing circuit 54 divides the clock Cw by ½ in order to generate a switch control signal Csw for switching between writing into and reading from the memories 11 and 12. Further, a circuit 55 for generating a clock CL1 generates a frequency signal three times the clock Cw. This CL1 is a clock of a T/3 cycle. Further, a circuit 56 thins out one pulse from the clock of CL1 in order to generate a clock CL2 having two pulses in the period T. The clock resulting from combining CL1 and CL2 becomes the reading timing clock CR.

Meanwhile, a vertical counter 52 counts a vertical synchronization signal VSYNC. This count value indicates the sequence number of the scanning lines of the image signals within one field period. This count value is decoded by a decoder 57, and the decoding contents are changed in accordance with a switching signal FR between the first and second fields. That is, in the first field, upon receiving the signal FR, the decoder 57 outputs an H level for the case of the first to eighth scanning lines and outputs an L level for the case of the ninth to eleventh scanning lines. Similarly, the signal levels are alternately changed between units of eight scanning lines and units of three scanning lines. Upon receiving an H-level output from the decoder 57, a switch 61 selects CL1, and upon receiving an L-level output from the decoder 57, the switch 61 selects C12. As a result of the above, a reading timing clock CR of the first field and a shift clock CLy of a scanning-line driving circuit 102 are generated. On the other hand, in the second field, upon receiving the switching signal FR, an L level is output in the case of the first to third scanning lines and an H level is output in the case of the fourth to eleventh scanning lines. Similarly, the signal levels are alternately changed between units of eight scanning lines and units of three scanning lines. Upon receiving an H level output from the decoder 57, the switch 61 selects CL1, and upon receiving an L level output from the decoder 57, the switch 61 selects CL2. As a result of the above, the reading timing clock CR of the second field and the shift clock CLy of the scanning-line driving circuit 102 are generated.

Further, a reading clock CLR for reading from the memory is generated from a circuit 59 in synchronization with the reading timing clock CR. Further, within the cycle T/3 of the reading timing clock CR, in order to sample image signals for one scanning line and supply the signals to the data lines by a data-line driving circuit 104, a circuit 60 generates a shift clock CLx in synchronization with CR.

(Description of a Specific Example of a Liquid-Crystal Display Apparatus)

Figure 7:
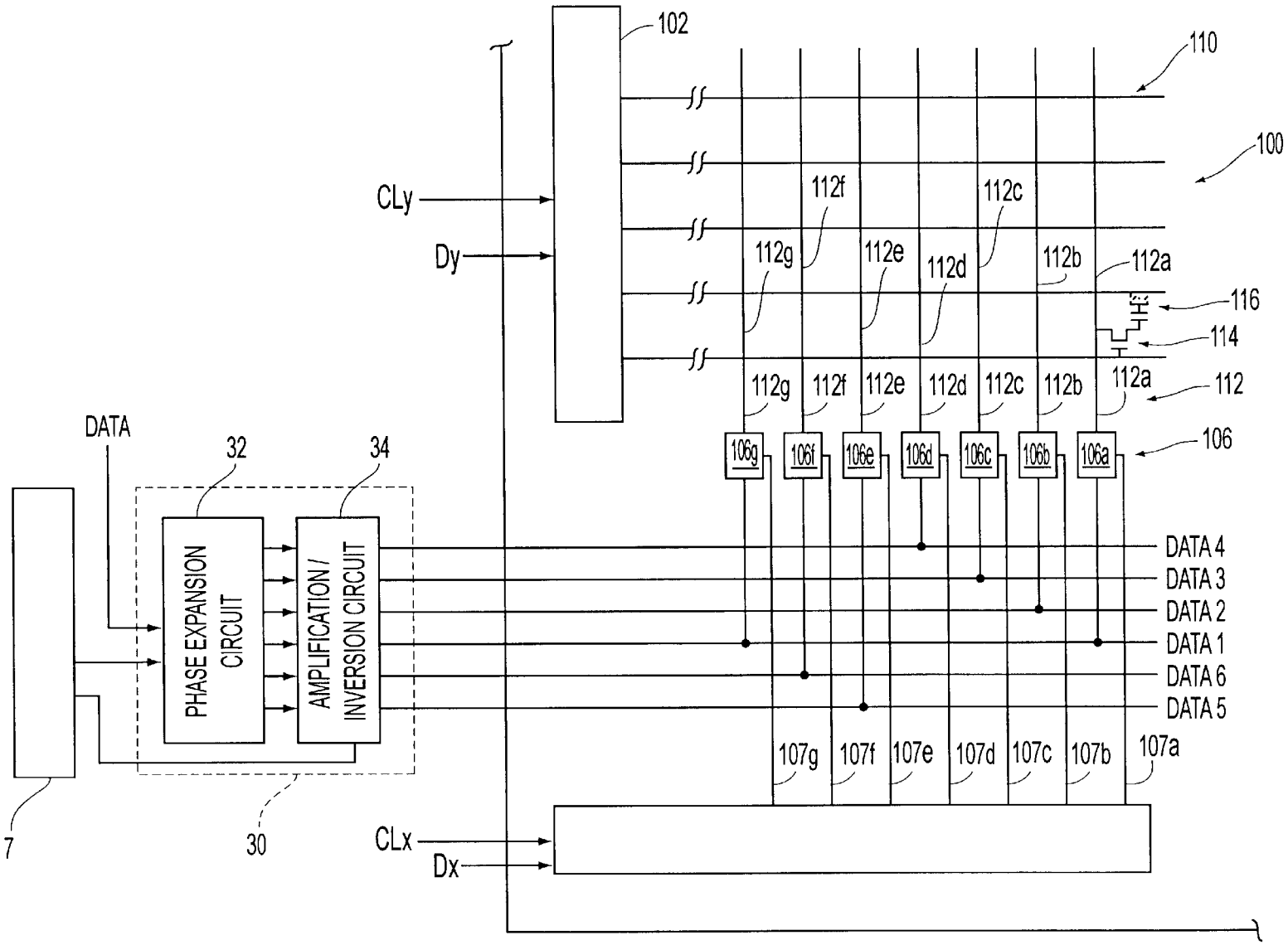
FIG. 7 shows the circuitry of the active-matrix-type liquid-crystal apparatus which is shown as an example of the display apparatus in FIG. 1.
Figure 8:
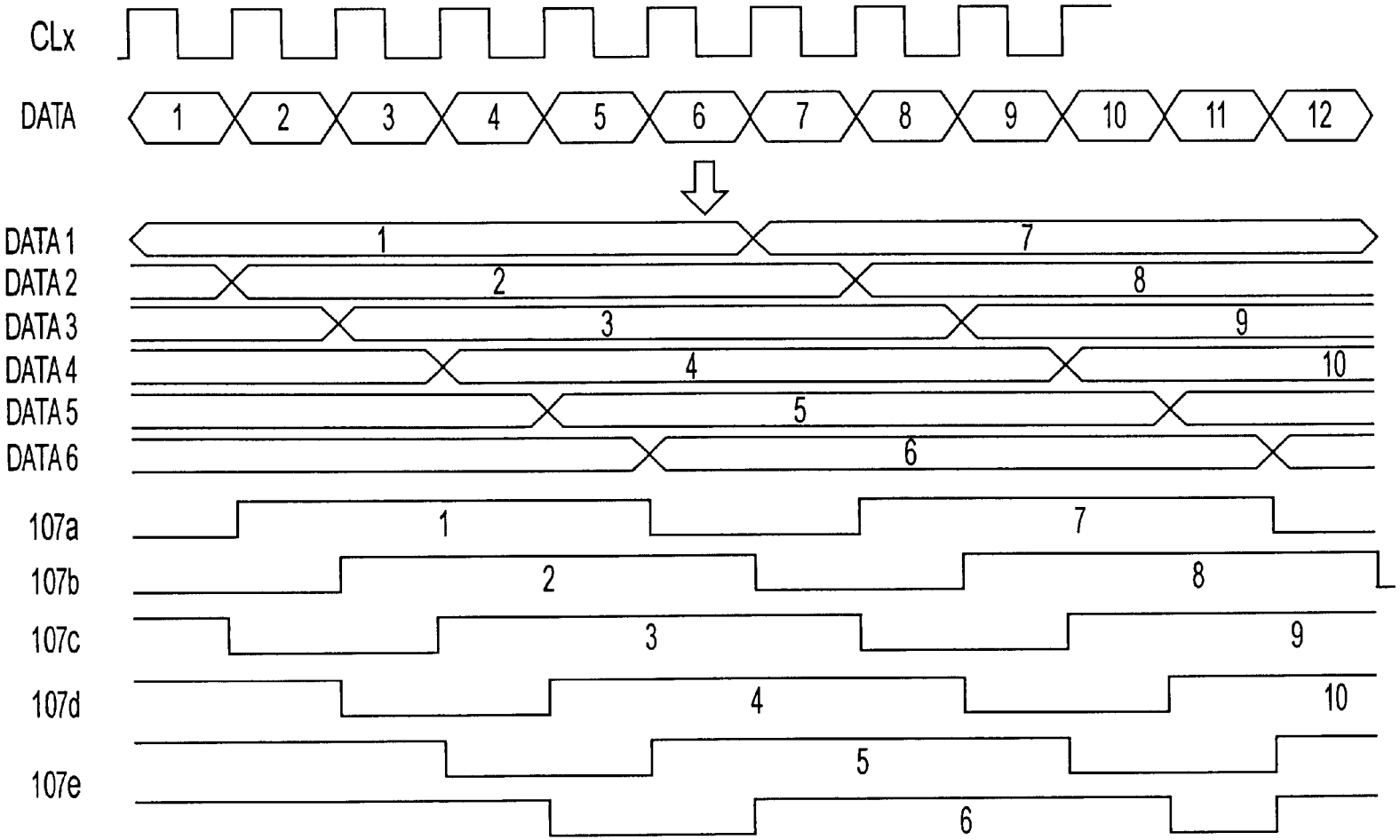
FIG. 8 is a waveform chart illustrating the operation of a data-line driving circuit in the circuitry in FIG. 7.

FIG. 7 shows the circuitry of an active-matrix-type liquid-crystal apparatus which is shown as an example of the display apparatus in FIG. 1. FIG. 8 is a waveform chart illustrating the operation of a data-line driving circuit in the circuitry in FIG. 7.

This embodiment is concerned with a small liquid-crystal display apparatus used as a light valve of, for example, a liquid-crystal projector, which liquid-crystal display apparatus is broadly classified into a liquid-crystal panel block 10, a control circuit 7, and a data processing circuit 30.

The control circuit 7 has the same construction as that in FIGS. 1 and 4.

The data processing circuit 30 has a phase expansion circuit 32 and an amplification/inversion circuit 34. The phase expansion circuit 32 outputs in parallel phase-expansion data signals of n phases, in which image signals Data input in a time-sequence manner are developed into n phases (n=6 in this embodiment). If a liquid-crystal panel 100 in the liquid-crystal panel block 10 is a color liquid-crystal panel having color filters of the three primary colors, three image signals of RGB are input in parallel to the phase expansion circuit 32, and, for example, 6 phase expansion data signals are generated from each of these three image signals and can be output as 18 parallel phase-expansion data signals.

The amplification/inversion circuit 34 amplifies phase-expansion data signals of n phases into voltages required to drive the liquid-crystal panel and inverts the polarities thereof with respect to the reference potential for polarity inversion if it is necessary. The positions of the amplification/inversion circuit 34 and the phase expansion circuit 32 may be opposite.

Further, the data processing circuit 30 performs 6-phase expansion, with 6 output lines of Data1 to Data6 being formed.

The liquid-crystal panel block 10 comprises a liquid-crystal panel 100, a scanning-line driving circuit 102 and a data-line driving circuit on the same circuit substrate. As shown in FIG. 1, these driving circuits may be formed as external ICs separately from the substrate of the liquid-crystal panel.

Figure 5:
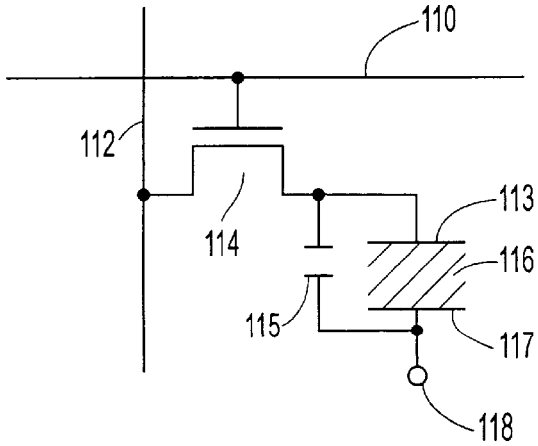
FIG. 5 shows the construction of one pixel of an active-matrix-type liquid-crystal apparatus which is shown as an example of a display apparatus.

A plurality of scanning lines 110 (H1 to Hm) which extend along a row direction and a plurality of data lines 112 (V1 to Vm) which extend along a column direction are formed on the liquid-crystal panel 100. At the positions of pixels formed by the intersections of the scanning lines 110 and the data lines 112, switching elements 114 and liquid-crystal layers 116 are connected in series to form pixels. The structure of this pixel is shown in detail in FIG. 5. In FIG. 5, a thin-film transistor (TFT) 114 is connected as an example of a switching element to the scanning line 110 and the data line 112. The source of the TFT is connected to the data line 112, the drain is connected to a pixel electrode 113, the gate is connected to the scanning line 110. Reference numeral 117 denotes a common electrode to which a common electrode potential is applied. Sandwiched between the pixel electrode 116 and the common electrode 117 is a liquid-crystal layer of 116. The image signal supplied to the pixel electrode 113 via the TFT 114 reverses its polarity at each vertical scanning period (one field) with a common electrode potential 118 as a reference. Reference numeral 115 denotes a storage capacitor, provided in a pixel, for holding the voltage of the image signal.

The TFT 114 conducts when a scanning signal is applied to the scanning line 110, causing the pixel to be in a selected state. At this time, the image signal supplied to the data lines 112 at this time is supplied to the liquid-crystal layer 116 and the storage capacitor 115 via the TFT. The state in which the TFT 114 is in a non-conducting state is a non-selection state, and the voltage stored at this time in the liquid-crystal layer and the storage capacitor is held.

Although a TFT of a three-terminal element is used for the TFT 114 in the case of FIG. 7, the TFT 114 is not limited to this and may be a two-terminal element. As two-terminal elements, MIM (metal-insulation layer-metal) elements, MIS (metal-insulation layer-semiconductor layer) elements, and diode elements are possible. Further, in the present invention, the pixel structure of the liquid-crystal panel may be, in addition to such an active-matrix type, a passive-matrix-type liquid-crystal panel which has no switching elements in the pixels and which uses liquid-crystal layers sandwiched between scanning lines and data lines as pixels.

In the liquid-crystal panel 100 of this embodiment, a substrate on which the scanning lines 110, the data lines 112, the TFTs connected to such lines, and further the pixel electrode 113 and the storage capacitors 115 are formed is made a first substrate, and a substrate which faces the foregoing substrate and on which the common electrode 117 is formed is made a second substrate. A liquid-crystal layer is filled in the space adjoining one substrate. Further, the scanning-line driving circuit 102 and the data-line driving circuit are formed of TFTs formed on the first substrate.

The scanning-line driving circuit 104 causes an incorporated shift register to input shift data Dy at the start of the field and outputs scanning signals in sequence to a plurality of scanning lines 110*a*, 110*b* . . . by shifting this data in accordance with the shift clock CLy in order to select scanning lines.

The data-line driving circuit is formed of a shift register 104 for shifting the shift data Dx in accordance with the shift clock CLx, and a switching element 106 for, upon receiving a sampling signal 107 generated on the basis of an output from this shift register, sampling image signals output to data lines Data1 to Data6 and supplying them to the data line 112.

The timing charts of the sampling signal 107 and image signals Data1 to Data6 which are phase-developed in the data-line driving circuit are shown in FIG. 8. The image signals Data1 to Data12 in FIG. 8 each indicate a one-dot analog image signal for one scanning line. The phase development circuit 32 which performs 6-phase development samples this image signal in accordance with a dot clock. This sampling signal is a clock having the same cycle as CLx. Further, this sampled image signal is formed into a 6-phase development signal which is converted into a cycle (a 6-clock cycle) longer than the sampling cycle. Reference numeral 107*a*, 107*b*, . . . each denote a scanning signal for sampling this phase-developed image signal and supplying the signal to the data line. In the H-level period of 107*a*, the switching element 106*a* samples the image signal of the first dot from line Data1. Similarly, in the H-level period of 107*b*, the switching element 106*b* samples the image signal of the second dot from line Data2. Hereinafter, each sampling is performed in a similar manner.

Therefore, since a sampling period sufficiently longer than the dot clock for transferring the image signals can be secured, it is possible to surely supply image signals to the data lines. Further, a high-speed operation is difficult because sampling is performed by TFTs; however, since the operation changes to a low-speed operation as a result of phase development, the operation becomes stabilized.

(Description of an Electronic Apparatus using the Display Apparatus)

An embodiment of an electronic apparatus constructed by using the liquid-crystal display apparatus of the above-described embodiment will be described below.

Figure 9:
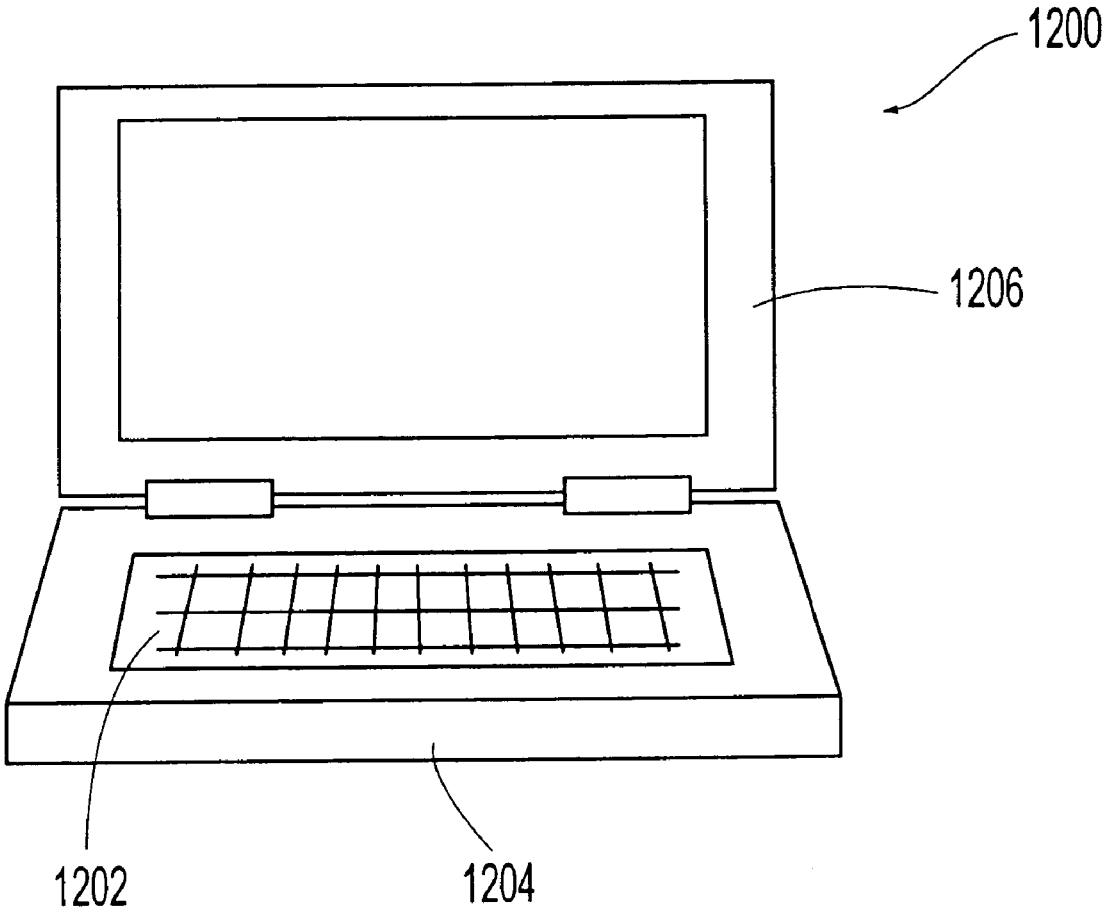
FIG. 9 is an exterior view of a personal computer using the display apparatus of the present invention.
Figure 10:
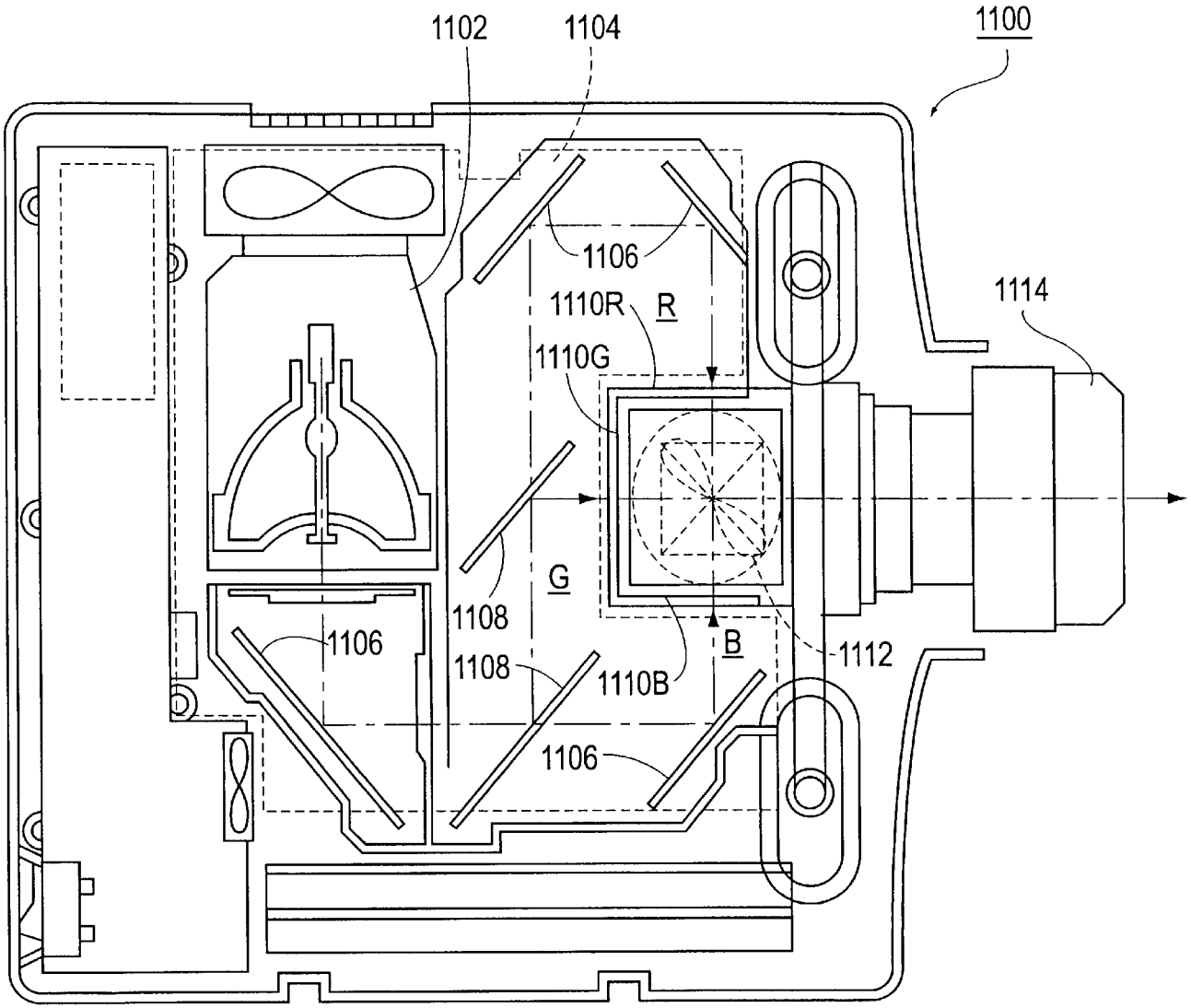
FIG. 10 is a plan view of a liquid-crystal projector in which the display apparatus of the present invention is used as a light valve.

Examples of an electronic apparatus using a liquid-crystal display apparatus include a personal computer (PC) and an engineering work station (EWS) which support multimedia shown in FIG. 9, as well as a projector shown in FIG. 10, a portable telephone, a word processor, a television, a view-finder-type or monitor-direct-view-type video tape recorder, an electronic pocket notebook, an electronic desktop calculator, a car navigation apparatus, a POS terminal, and an apparatus equipped with a touch panel.

A personal computer 1200 shown in FIG. 9 has a main-unit section 1204 provided with a keyboard 1202, and a liquid-crystal display screen 1206.

The liquid-crystal projector shown in FIG. 10 is a projection-type projector using a transmission-type liquid-crystal display apparatus as a light valve, which projector uses an optical system of, for example, a three-panels & prism system. In FIG. 10, in a projector 1100, projection light emitted from a lamp unit 1102 of a white-color light source is separated into the three primary colors of R, G and B by a plurality of mirrors 1106 and two dichroic mirrors 1108 inside a light guide 1104, and are guided into 3 liquid-crystal display apparatuses 1110R, 1110G and 1110B which display an image of their respective colors. Then, the light modulated by the respective liquid-crystal display apparatuses 1110R, 1110G and 1110B is made to enter a dichroic prism 1112 from three directions. Since in the dichroic prism 1112, light of red R and blue B is bent 90°, and light of green G travels straight, images of each color are combined, and a color image is projected on a screen or the like through a projection lens 1114.

(Modification)

Next, a description will be given of a modification of the display apparatus in accordance with the above-described embodiment.

In the display apparatus in accordance with the above-described embodiment, an example is described in which a SVGA liquid-crystal panel 1 having 600 lines is used. However, the number of lines is not limited to this, and the number of scanning lines of the liquid-crystal panel 1 may be any number of lines.

In this case, the number of scanning lines of the subject liquid-crystal panel 1 to which an image signal Video corresponding to each scanning line should be made to correspond may be determined as desired on the basis of the relationship between the number of scanning lines of the liquid-crystal panel 1 to be used and the number of scanning lines of the image signal Video so that the image is displayed on the entire liquid-crystal panel 1.

Further, in the display apparatus in accordance with the above-described embodiment, an example is described in which the reading timing clock CR shown in FIG. 2 is such that each period corresponding to image signals for one to eight scanning lines is of three pulses, and each period corresponding to image signals for nine to eleven scanning lines is of two pulses. However, the present invention is not limited to this, and the positions of the foregoing two pulses may be any positions.

For example, in FIG. 2, as the reading timing clock CR of the first field, a clock may be used such that a period corresponding to the first, third and fifth scanning lines is of two pulses and a period corresponding to the second, fourth, and sixth to eleventh scanning lines is of three pulses. Further, when the positions of the above-described two pulses are changed, the shift clock CLy for driving scanning lines, shown in FIG. 2, must also be changed to the same number as that of the reading timing clock CR.

Further, as a result of the above-described change of the reading timing clock CR of the first field shown in FIG. 2, the reading timing clock CR of the second field shown in FIG. 3 must also be changed. That is, in the above-described change, a reading timing clock CR of the first field shown in FIG. 3 may be used such that a period corresponding to the second, fourth and sixth scanning lines is of two pulses and a period corresponding to the first, third, fifth, and seventh to eleventh scanning lines is of three pulses.

Further, in the display apparatus in accordance with the above-described embodiment, an example is described in which the cycle per one pulse of the reading timing clock CR shown in FIG. 2 is made T/3. However, the present invention is not limited to this, and the cycle may be changed as desired according to the number of scanning lines of the liquid-crystal panel 1.

For example, in FIG. 2, in the period T corresponding to the image signals Video8 of the eighth scanning line and the period T corresponding to the image signals Video9 of the ninth scanning line, i.e., in the cycle 2T such that three pulses and two pulses are adjacent to each other, the cycle for one pulse may be made a cycle such that 5 (=3+2) pulses are positioned equally in terms of time. That is, in this case, since five pulses are present in the cycle 2T, one cycle per one pulse may be set to 2T/5.

Further, when the same image signals for one scanning line are read N times, image signals for a certain scanning line may be read one time, and the image signals for the other scanning line may be read a plurality of number of times. That is, N may be an integer of 1 or more.

Further, N may be, in addition to two values, set to three or more values. That is, although in the present invention N is of two values of two times and three times, it may be a reading number of times of three values of one time, two times, and three times. However, an increase in the types of N causes the construction of the decoder 57 in FIG. 4 to become complex, and therefore, using two types is desirable.

Further, in the display apparatus in accordance with the above-described embodiment, an example is described in which an image obtained from image signals of an interlace (interlaced scanning) system is displayed on the liquid-crystal panel 1. However, the present invention is not limited to this, and even with image signals of an non-interlace system, whose number of scanning lines in one vertical scanning period is smaller than the number of scanning lines of a liquid-crystal panel, it is possible to display the image on the liquid-crystal panel 1 in a similar manner as the above-described method.

Further, in the display apparatus in accordance with the above-described embodiment, an example is described in which image signals for one scanning line are written and read in sequence using the line memory 5. However, in place of this line memory 5, a frame memory capable of storing image signals for one frame may be used.

In addition, in the display apparatus in accordance with the above-described embodiment, an example is described in which an active-matrix-type liquid-crystal panel 1 is used as a display in which liquid crystal is used for display elements and TFTs are used for switching elements of pixels. However, the display is not limited to this, and as a liquid-crystal panel, a matrix-type liquid-crystal panel using two-terminal elements as switching elements, or a passive matrix-type liquid-crystal panel may be used. Furthermore, displays of display elements (a CRT, FED, plasma display, electro-luminescence, etc.) of any other types may be used.

In the foregoing, according to the present invention, since the same image signals for one scanning line are read a plurality of number of times from storage means, even if the number of scanning lines of display means is greater than that of the image signals, an advantage can be obtained in that the image can be displayed on the entire display means. Further, even when the number of scanning lines of display means is not an integral multiple of that of the image signals, an advantage can be obtained in that the image can be displayed on the entire display means, and the resolution can be improved since there is no need to cut the fraction of the number of scanning lines of the image signals. Furthermore, since the positions of the image signals read a first number of times are shifted between the first field and the second field, an advantage can be obtained in that the resolution can be further improved.

Industrial Applicability

As described above, the display apparatus in accordance with the present invention can be used as a display apparatus for a personal computer, a work station and the like, and further as a monitor for a multimedia terminal apparatus, television and the like.

What is claimed is:

1. A method of driving a display apparatus which has a plurality of display scanning lines and supplies image signals for a number of image scanning lines less than a number of the plurality of display scanning lines to display elements controlled by said plurality of display scanning lines, comprising:

supplying the image signals of each scanning line to display elements controlled by N (N is an integer) display scanning lines of the display apparatus, and within one vertical scanning period, repetitively changing the number N of display scanning lines corresponding to display elements to which said image signals are supplied according to a sequence number of the image scanning lines, the number N being repetitively changed with a predetermined pattern.

2. The method of driving a display apparatus according to claim 1, wherein there are two values of N of display scanning lines corresponding to display elements to which said image signals are supplied within one vertical scanning period, and the two values of N are selected according to the sequence number of the image scanning lines.

3. The method of driving a display apparatus according to claim 1, wherein the values of said N are values N1, N2, . . . Ni (i is an integer of 2 or more) which satisfy the following equations (1), (2) and (3), where $$L=M1+M2+\ldots+Mi \quad (1)$$

$$Hm=N1\times M1+N2\times M2+\ldots+Ni\times Mi \quad (2)$$

$$L<Hm \quad (3)$$

and

L: a sum of effective image scanning lines of image signals within one vertical scanning period Hm: a sum of effective display scanning lines of the display apparatus Ni: a number of display scanning lines of the display apparatus, selected to supply the image signals for one image scanning line to the display elements Mi: a number of image scanning lines of the image signals within one vertical scanning period, for which the image signals for said image scanning lines are generated Ni times.

4. The method of driving a display apparatus according to claim 3, wherein L is 220, Hm is 600, N1 is 3, N2 is 2, M1 is 160, and M2 is 60.

5. The method of driving a display apparatus according to claim 1, further comprising changing the number N of display scanning lines corresponding to the display elements to which said image signals are supplied within one vertical scanning period at each vertical scanning period.

6. The method of driving a display apparatus according to claim 1, wherein there are two values of N of display scanning lines corresponding to the display elements to which said image signals are supplied within one vertical scanning period, and wherein the two values of N are selected according to the sequence number of the image scanning lines of said image signals, further comprising changing N at each vertical scanning period.

7. The method of driving a display apparatus according to claim 1, wherein said display elements are a liquid crystal.

8. A method of driving a display apparatus which has a plurality of display scanning lines and which supplies image signals for a number of image scanning lines less than a number of the plurality of display scanning lines to display elements controlled by said plurality of display scanning lines, said method comprising the steps of:

storing the image signals of each image scanning line in memory;

reading the image signals for one image scanning line stored in the memory N times (N is an integer) within one horizontal scanning period;

supplying said image signals read N times to display elements controlled by N display scanning lines of the display apparatus; and repetitively changing said number N of times of supplying with a predetermined pattern within one vertical scanning period.

9. The method of driving a display apparatus according to claim 8, wherein there are two values of N of display scanning lines corresponding to the display elements to which said image signals are supplied within one vertical scanning period, and the two values of N are switched according to a sequence number of the image scanning lines read from said memory.

10. The method of driving a display apparatus according to claim 8, wherein the values of said N are values N1, N2, . . . Ni (i is an integer of 2 or more) which satisfy the following equations (1), (2) and (3), where $$L=M1+M2+\ldots+Mi \quad (1)$$

$$Hm=N1\times M1+N2\times M2+\ldots+Ni\times Mi \quad (2)$$

$$L<Hm \quad (3)$$

L: a sum of effective image scanning lines of image signals within one vertical scanning period Hm: a sum of effective display scanning lines of the display apparatus Ni: a number of display scanning lines of the display apparatus, selected to supply the image signals for one image scanning line to the display elements Mi: a number of image scanning lines of the image signals within one vertical scanning period, for which the image signals for said image scanning lines are generated Ni times.

11. The method of driving a display apparatus according to claim 10, wherein L is 220, Hm is 600, N1 is 3, N2 is 2, M1 is 160, and M2 is 60.

12. The method of driving a display apparatus according to claim 8, further comprising changing the number N of display scanning lines corresponding to the display elements to which said image signals are supplied within one vertical scanning period at each vertical scanning period.

13. The method of driving a display apparatus according to claim 8, wherein there are two values of N of display scanning lines corresponding to the display elements to which said image signals are supplied within one vertical scanning period, and wherein the two values of N are selected according to the sequence number of the image scanning lines of said image signals, further comprising changing N at each vertical scanning period.

14. The method of driving a display apparatus according to claim 8, wherein said display elements are a liquid crystal.

15. A display apparatus which drives a display apparatus which has a plurality of display scanning lines and which supplies image signals for a number of image scanning lines less than a number of the plurality of display scanning lines to display elements controlled by said plurality of display scanning lines, said display apparatus comprising:

memory for storing the image signals corresponding to a number of image scanning lines;

control circuit for reading the image signals for one image scanning line stored in the memory N times (N being an integer of 1 or more); and driving circuit for supplying said image signals to display elements controlled by N display scanning lines, wherein the number N of times in which said image signals are read from said memory is repetitively changed with a predetermined pattern within one vertical scanning period.

16. The display apparatus according to claim 15, wherein there are two values of N of display scanning lines corresponding to the display elements to which said image signals are supplied within one vertical scanning period, and wherein the two values of N are selected according to the sequence number of the image scanning lines of said image signals, further comprising changing N at each vertical scanning period.

17. An electronic apparatus using the display apparatus according to claim 15.

* * * * *